United States Patent [19]

Vicino et al.

[11] 4,447,974

[45] May 15, 1984

[54] INFLATABLE BOTTLE REPLICA

[76] Inventors: Robert K. Vicino, 8847 Complex Dr., San Diego, Calif. 92123; Dale L. Cooper; Lauren M. Pembleton, both of 6140 Jackson Dr., San Diego, Calif. 92041; Constance C. Allen, 728 Robinson Ave., San Diego, Calif. 92103

[21] Appl. No.: 404,084

[22] Filed: Aug. 2, 1982 (Under 37 CFR 1.47)

[51] Int. Cl.[3] ..... G09F 1/08

[52] U.S. Cl. ..... 40/538; 40/212; 40/214

[58] Field of Search ..... 40/538, 212, 214, 215, 40/610

[56] References Cited

U.S. PATENT DOCUMENTS 3,670,440 6/1972 Yost ..... 40/538

4,369,591 1/1983 Vicino ..... 40/214

FOREIGN PATENT DOCUMENTS 968613 9/1964 United Kingdom ..... 40/538

OTHER PUBLICATIONS

Page 18, Washington Daily News for Aug. 9, 1960.

*Primary Examiner*—Gene Mancene

*Assistant Examiner*—Wenceslao J. Contreras

*Attorney, Agent, or Firm*—Charmasson & Holz

[57] ABSTRACT

Means and method are provided for creating giant simulated soft drink bottles, with distinctive shapes more particularly the type having generally longitudinally extended ribs which serve as trade dress. The construction utilizes a series of side panels which are laid out and sewn edge to edge, subsequent to which chalk lines are marked onto the side panels, indicating where the furrows between the longitudinal ribs are to go, and gussets are sewn along each chalk line and centrally restrained with a strap or the like which runs longitudinally of the bottle, so that when the top and bottom portions are installed and the unit is inflated, the trade dress ribs and furrows are well defined in the outer surface of the bottle.

10 Claims, 14 Drawing Figures

FIG. 10
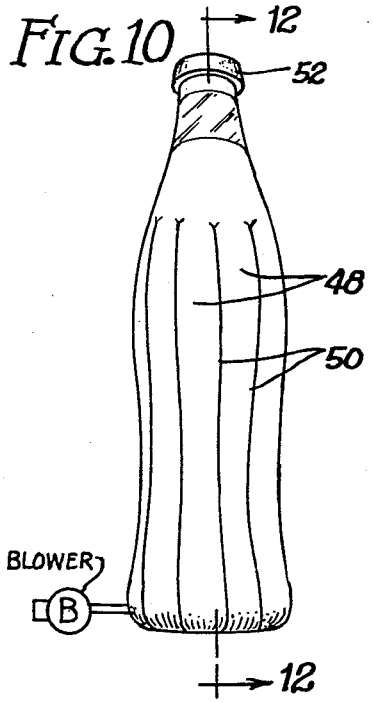
FIG. 12
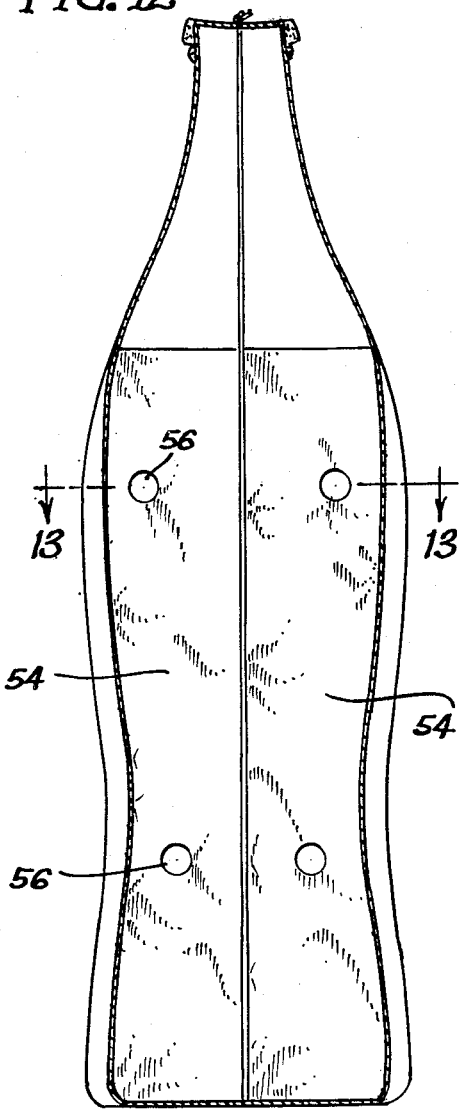
FIG. 11
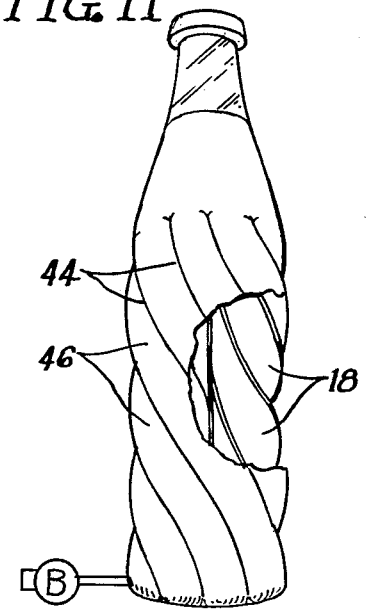
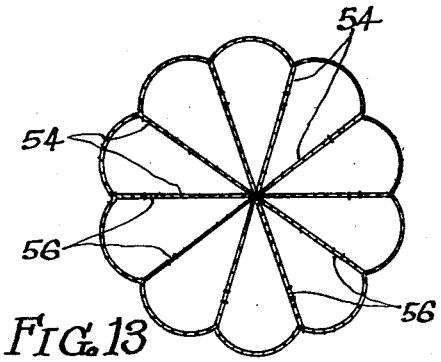
FIG. 13

INFLATABLE BOTTLE REPLICA

BACKGROUND OF THE INVENTION

The invention is in the field of three-dimensional inflatable promotional displays, in which the inventor has been an industry leader for years. More particularly, the invention pertains to giant inflated replicas of soft drink bottles, such as PepsiCola and CocaCola bottles, which have external ribs running generally longitudinally of the bottle. These ribs have come to be identified closely with the soft drinks that they contain. The longitudinal ribs of the CocaCola bottle make that bottle easily recognizable even when the name is covered, and the same is true of the slightly spiralled ribs of the PepsiCola bottle.

However, unlike the creation of a cylindrical soft drink or beer can in which the billowing influence of internal pressure is an aid in maintaining the proper shape, the alternate ribs and furrows of the PepsiCola and CocaCola bottles require an internal structure to restrain the skin along the furrows, permitting the billowing therebetween of the ribs. Otherwise, the body of the bottle would simply bloat out into a cylinder and would not be simulate the actual bottle. However, whereas it is easy to generate as many glass bottles as one wants from a mold of virtually any shape, the creation of an inflatable which will adequately define the ribs has required considerable experimentation and ingenuity.

SUMMARY OF THE INVENTION

In order to create these giants, the main body of the bottle is divided angularly into several side panels, four in the drawings and description and in practice, although conceivably more or fewer could be used. These side panels are rectangular in their lower portions and tapered in their upper portions to define the upper, converging portion of the bottle.

The side panels are laid out on a horizontal surface with their parallel edges sewn to adjacent side panels, leaving only the two outermost parallel edges of the series to be sewn together to define a sleeve which would be cylindrical when inflated.

Once this series of panels is sewn together and lying on a flat horizontal surface, chalk lines are made where the furrows in the finished bottle are to be. In the case of a simulated PepsiCola bottle, the chalk lines are straight diagonal lines, and CocaCola bottle simulations require axially extended, parallel lines.

Once the lines have been drawn, a series of gussets are sewn with one edge along the line, and the other edge eventually becomes attached to a central strap which acts as a restraint on the external skin to define the furrows when the bottle is completed and inflated.

BRIEF DESCRIPTION OF THE DRAWINGS

FIG. 10 is a front elevation view of the second embodiment of the invention, representative of a CocaCola bottle;

FIG. 11 illustrates the first embodiment of the invention again, showing portions of the skin cut away to more clearly reveal the gusset structure when the unit is inflated;

FIG. 12 is section taken along line 12—12 of FIG. 10; and

FIG. 13 is section taken along line 13—13 of FIG. 12.

DETAILED DESCRIPTION OF THE PREFERRED EMBODIMENT

Figure 1:
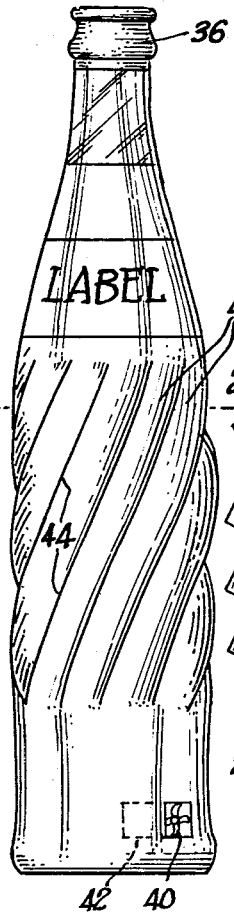
FIG. 1 is a front elevation view of the first embodiment of the invention, which is a simulated PepsiCola bottle.
Figure 6:
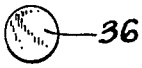
FIG. 6 is an elevation view of the top cap panel.
Figure 5:
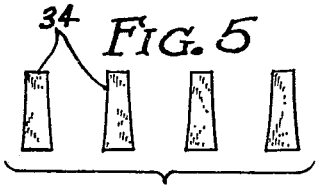
FIG. 5 illustrates the neck panels.
Figure 3:
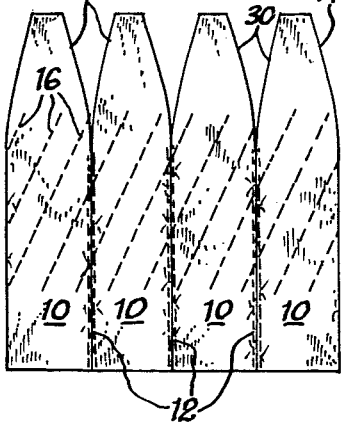
FIG. 3 is a top plan view of the side panels laid out horizontally and sewn together.

The bottle shown in FIG. 1 begins as four side panels 10, having lower parallel edges 12 which taper inwardly along their top portions at 14. These panels are laid out on a horizontal surface as shown in FIG. 3 and the side edges are stitched together to define an integral series of panels.

Thereafter, parallel diagonal chalk lines 18 are scribed onto the surface of the side panels at the positions where the furrows between the ribs on the bottle should go. Once this has been done, gussets 18 are sewn along their outer edge to the respective chalk lines 16. The end side panels have some shorter gussets 19, for obvious geometrical reasons, which will butt up against other shorter gussets at the other end panel when the panels are rolled into a cylindrical sheath.

Figure 4:
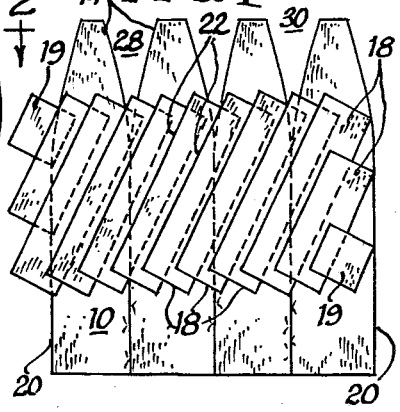
FIG. 4 illustrates the panels of FIG. 3 with the restraint gussets sewn along the chalk lines.
Figure 7:
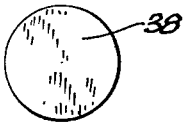
FIG. 7 is a reduced plan view of the bottom panel.
Figure 2:
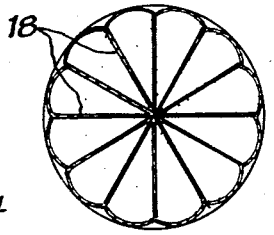
FIG. 2 is a section taken along line 2—2 of FIG. 1.
Figure 8:
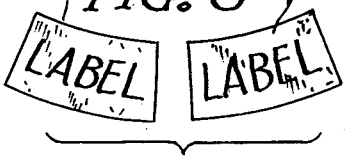
FIG. 8 illustrates the labels which identify the brand of the soft drink.

After the gussets are installed as shown in FIG. 4, the panel series is folded over so that the outer edges 20 align, and they are then sewn together so that a loose sheath is formed which would be generally cylindrical when inflated. After this sheath has been made, certain of the gussets may have to be sewn that could not be sewn before, especially if the long-type gusset was used throughout and none of the shortened gussets 19 were used. In this event, certain gussets lapping over the edges 20 would have to be sewn after the seam between the edges is sewn.

Figure 9:
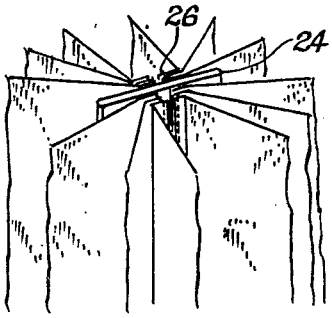
FIG. 9 illustrates the way in which the gussets are connected to the central strap at their inner edge.
Figure 9A:
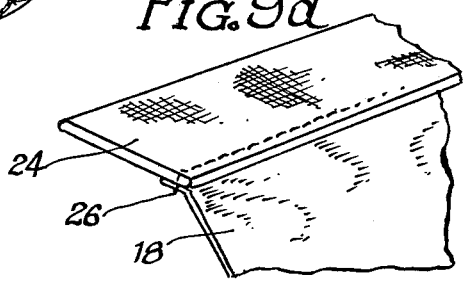

A central strap 22 extends generally axially through the bottle when it is finished. This serves as the radial restraint for the gussets and thus the furrows, and the radially inner edges of the gussets are sewn to the strap at 26, as shown in FIG. 9.

At this point the upper, tapered edges of the side panels indicated at 28 and 30 are sewn, with the intermediate tapered edges not sewn at this time. Labels 32 are now sewn over the upper portions of the side panels 10, across the seams 28 and 30, respectively.

A zipper deflation may be installed now between the labels, and then the trapezoidal segments 34 are ready to be sewn in place to define the transparent neck of the bottle. At this point, cap 36 and bottom 38 may be sewn in place, with the exact nature of these connections being subject to some change and not representing inventive features of this invention. A blower 40 must be installed together with a tunnel 42 either inside or outside the skin, to insure a continuous pressure is applied against the inside of the bottle skin despite the inevitable leakage caused in large part by stitch lines. As shown in the embodiment of FIG. 1, the tunnel and blower are internal of the bottle skin.

When inflated, the bottle looks as it is shown in FIG. 1 from the outside. The internal structure can be visualized somewhat better in FIG. 11, wherein an embodiment is shown with an external blower. The cutaway side illustrates the helical shape that the gussets assume when the skin of the bottle is inflated, drawing the outer edge of the gussets along a helical path to define helical furrows 44 with billowed out ribs 46 therebetween. Once the indicia of the PepsiCola bottle are added, which generally would be done prior to assembly, the replica is striking in its degree of similarity to the appearance of an actual PepsiCola bottle.

The second embodiment of the invention is shown in FIGS. 10, 12 and 13, wherein the same basic structure is used, but the ribs 48 are vertical and separated by furrows 50. The side panels may continue up to the top cap 12 of the bottle, but ordinarily would be patched in with trapezoidal transparent panels as was the Pepsi bottle as an easy way of delineating the meniscus of the beverage from the overlying air.

Naturally the gussets 54 in the CocaCola bottle are straight rather than being helical, and may extend all the way to the top of the bottle, in which case breather holes 56 would need to be used. Although the CocaCola bottle is identifiable by its shape, some bottles utilize the trademark written across them, and such would appear on the simulated bottle.

While the preferred embodiment of the invention has been described, other modifications may be made thereto and other embodiments may be devised within the spirit of the invention and scope of the appended claims.

What is claimed is:

1. A giant inflatable generally cylindrical body simulating a product with distinctive trade dress comprising:

(a) a generally cylindrical external envelope dimensioned and shaped to simulate the external appearance of said body when inflated; and to define an internal chamber, in the absence of any rigid supporting element;

(b) a plurality of generally longitudinally extended ribs and furrows defined on the surface of said envelope (c) within said chamber a plurality of interconnected shaping means having outer ends attached along said furrows said shaping means having their inner ends joined together along a generally longitudinal axis in the center of said chamber to create an inward radial restrain along said furrows while said ribs billow out under internal inflating fluid pressure applied against the inner face of said envelope.

2. Structure according to claim 1 wherein said shaping means comprise a plurality of radial gussets made entirely of fabric having their outer edge connected continuously along each of said furrows.

3. Structure according to claim 2 wherein said gussets each extend substantially the axial length of the ribs in said body and are connected together along their radially inner edge.

4. Structure according to claim 3 wherein said gussets are fastened along their radially inner edge to an axial strap.

5. Structure according to claim 4 wherein said gussets are each fastened along their outer edges to said skin along a spiral line to create a spiral rib swirl in the surface of said envelope.

6. Structure according to claim 5 wherein said gussets are fastened to the inner surface of said envelope along axially extended parallel lines on said surface to create straight parallel ribs and furrows therein.

7. Structure according to claim 1 and including a pressurization means introducing a continuous supply of pressurized air into said chamber.

8. Structure according to claim 7 wherein said pressurization means includes a blower inside said chamber admitting ambient air through an opening in said envelope.

9. A method of making a giant inflatable simulated beverage bottle having a bottom, a lower body portion defining a series of generally longitudinal ribs, an upper portion converging into a neck, and a neck terminating in a cap comprising the following steps:

(a) cutting a plurality of side panels representing segments of the lower body portion and upper portion of said bottle, having parallel edges along the central and bottom portion corresponding to said lower body portion and tapered along its upper edges corresponding to said upper portion;

(b) laying out said side panels in a series on a surface with said side edges together and sewing together the parallel side edges of each adjacent pair of panels;

(c) marking on said panels lines representing the furrows between said ribs;

(d) sewing a gusset along each of said lines;

(e) sewing the loose side edges of the two end panels in said series to define a generally cylindrical sheath;

(f) sewing the radially inner edges of said gussets to an axially strip extending through said sheath;

(g) sewing together the tapered edges of adjacent panels; and (h) attaching neck panels and a cap panel atop said side panels, and fastening a circular bottom panel around the bottom of said side panel to complete the integrity of the bottle.

10. Structure according to claim 9 wherein said ribs are spiral and Step d involves sewing some of said gussets along only partial lengths of said furrows with the rest of the respective gussets sewn after Step e because some gussets span the side panel seam which is sewn in Step e.

* * * * *